US009688497B2

(12) United States Patent
Matsuo et al.

(10) Patent No.: US 9,688,497 B2
(45) Date of Patent: Jun. 27, 2017

(54) IMAGE-FORMING APPARATUS THAT FORMS AN IMAGE ON A SHEET OF CONTINUOUS RECORDING MEDIUM

(71) Applicant: Konica Minolta, Inc., Tokyo (JP)

(72) Inventors: Masahiro Matsuo, Tokyo (JP); Makoto Ui, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 30 days.

(21) Appl. No.: 14/956,314

(22) Filed: Dec. 1, 2015

(65) Prior Publication Data

US 2016/0185142 A1 Jun. 30, 2016

(30) Foreign Application Priority Data

Dec. 26, 2014 (JP) ..... 2014-265953
Feb. 18, 2015 (JP) ..... 2015-029530

(51) Int. Cl.
*B65H 20/00* (2006.01)
*B41J 11/00* (2006.01)
*B41J 15/04* (2006.01)

(52) U.S. Cl.
CPC ..... *B65H 20/00* (2013.01); *B41J 11/008* (2013.01); *B41J 11/0095* (2013.01); *B41J 15/04* (2013.01); *B65H 2601/524* (2013.01)

(58) Field of Classification Search
CPC . B41J 13/0009; B65H 20/00; B65H 2601/524
See application file for complete search history.

(56) References Cited

U.S. PATENT DOCUMENTS

2006/0170720 A1* 8/2006 Akase ..... B41J 11/0095 347/14
2008/0007800 A1* 1/2008 Yamamoto ..... H04N 1/0057 358/498

(Continued)

FOREIGN PATENT DOCUMENTS

JP H4-153675 5/1992
JP 2007-091347 4/2007

(Continued)

OTHER PUBLICATIONS

Notification of Rejection Reason(s) mailed Jan. 6, 2017 for Japanese Patent Application No. 2015-029530, with English translation, 12 pages.

(Continued)

*Primary Examiner* — Alessandro Amari
*Assistant Examiner* — Roger W Pisha, II
(74) *Attorney, Agent, or Firm* — Squire Patton Boggs (US) LLP

(57) ABSTRACT

An image-forming apparatus forms an image on a roll sheet. A printer receives the roll sheet, forms the image thereon and ejects the image-formed roll sheet to a reel. A sheet position sensor, which is positioned near the printer, measures a position of the roll sheet along a width direction thereof. A control portion receives positional measurement data about the position of the roll sheet along the width direction thereof from the sheet position sensor and controls at least one of start time of image-forming operation in the printer and an image-writing position of the printer by settling at least one of the start time of image-forming operation and the image-writing position based on the positional measurement data.

14 Claims, 15 Drawing Sheets

(56) References Cited

U.S. PATENT DOCUMENTS

| | | | | |
|---|---|---|---|---|
| 2012/0240803 | A1* | 9/2012 | Sato | B41J 11/42 101/485 |
| 2016/0263915 | A1* | 9/2016 | Gracia Verdugo | B41J 11/009 |

FOREIGN PATENT DOCUMENTS

| | | |
|---|---|---|
| JP | 2008-233286 | 10/2008 |
| JP | 2008-233770 | 10/2008 |
| JP | 2014-172200 | 9/2014 |

OTHER PUBLICATIONS

Notification of Rejection Reason(s) mailed Jan. 30, 2017 for Japanese Patent Application No. 2014-265953, with English translation, 6 pages.

* cited by examiner

IMAGE-FORMING APPARATUS THAT FORMS AN IMAGE ON A SHEET OF CONTINUOUS RECORDING MEDIUM

CROSS REFERENCES TO RELATED APPLICATIONS

The present invention contains subject matters related to Japanese Patent Applications JP 2014-265953 and 2015-029530 filed in the Japanese Patent Office on Dec. 26, 2014 and Feb. 18, 2015, the entire contents of which being incorporated herein by reference.

BACKGROUND OF THE INVENTION

Field of the Invention

The present invention relates to an image-forming apparatus that forms an image on a sheet of continuous recording medium.

Description of Related Art

In recent years, an image-forming apparatus has been developed which forms an image on a sheet of continuous recording medium (hereinafter, also referred to as "sheet of continuous") such as a roll sheet and a performed form sheet. Such an image-forming apparatus contains a feeder that feeds the sheet of continuous paper, a printer that forms or prints the image on the sheet of continuous paper fed from the feeder, a sheet-receiving reel that receives the sheet of continuous paper fed from the printer and a control portion that controls operations of these feeder, printer and sheet-receiving reel. The printer includes an electrophotographic printer, an ink jet printer, a dot impact printer and the like.

For example, Japanese Patent Application Publication 2008-233770 has disclosed that in the image-forming apparatus, when conveying the sheet of continuous paper, any tension is applied to the sheet of continuous paper. In the image-forming apparatus, in order to position the sheet of continuous paper when conveying the sheet of continuous paper, each tension roller is aligned and/or any position correction device such as an edge guider and an edge position controller (EPC) uniformly positions an edge of the sheet of continuous paper. Further, a side guider and/or flanged roller may be used for settling a position of the sheet of continuous paper.

When the sheet of continuous paper is newly set, namely, fed into the image-forming apparatus, any vibration such that the sheet of continuous paper wobbles along a width direction thereof may occur when the sheet of continuous paper is newly conveyed. This is because although a person normally sets the sheet of continuous paper into the image-forming apparatus, it is very difficult for the person to set the sheet of continuous paper at a stable conveying position thereof.

Further, when exchanging parts relating to any variation of the sheet of continuous paper along the width direction thereof in the image-forming apparatus, any vibration such that the sheet of continuous paper wobbles along the width direction thereof may occur under the influence of any tension (conveying pressure). This is because the fixing device has a strong conveying force in, for example, the electrophotographic printer so that the sheet of continuous paper is also conveyed with a strong conveying force and exchanging the relating parts in the fixing device exerts a large influence on the conveyance of the sheet of continuous paper. Additionally, exchanging parts of a secondary transfer portion also exerts a large influence on any variation in the conveying pressure when conveying the sheet of continuous paper, so that any vibration such that the sheet of continuous paper wobbles along a width direction thereof may occur. Still further, when there is a fixing and separation compression operation in the fixing device of the electrophotographic printer, any vibration such that the sheet of continuous paper wobbles along a width direction thereof may also occur similarly because of large variation in the conveying pressure.

These vibrations are damped vibrations of sine wave so that when the sheet of continuous paper is conveyed by a given amount of conveyance, the vibrations stably converge. Accordingly, a past image-forming apparatus has conveyed the sheet of continuous paper while the printer has not printed the image, until the sheet of continuous paper does not wobble to be stably conveyed, in order to form or print the image on a set position of the sheet of continuous paper without moving the image position in the sheet of continuous paper. FIG. 1 shows a past image-forming apparatus 10 having such a mechanism.

The past image-forming apparatus 10 uses a roll sheet 18 as the sheet of continuous paper and includes a printer 12, a feeder 14 that feeds the roll sheet 18 and is positioned at an upstream side of the printer 12, and a reel 16 that is a sheet-receiving device and is positioned at a downstream side of the printer 12. The feeder 14 contains a shaft 20 of the roll sheet 18, a tension roller 22 and a guide roller 24. The printer 12 has a configuration that is similar to that of the past printer. The printer 12, in a case of, for example, the electrophotographic printer, contains exposing devices, photosensitive drums, an intermediate transfer belt, a secondary transfer roller, and a fixing device, which are not shown.

The reel 16 of the past image-forming apparatus 10 contains a reel shaft 26 of the roll sheet 18, a tension roller 30 and a guide roller 28. In the reel 16, a sheet position sensor 32 such as line sensors measures any vibration such that the roll sheet 18 wobbles along the width direction thereof. In the case of the line sensors, the sensors are arranged along the width direction of the roll sheet 18 and measure a position of an edge of the roll sheet 18. The image-forming apparatus 10 checks a measurement output signal from the line sensors and waits until an image position of the edge of the roll sheet 18 does not wobble and becomes stable. When checking that the roll sheet 18 is stably conveyed, the printer 12 forms or prints the image on the roll sheet 18.

SUMMARY OF THE INVENTION

By the way, the past image-forming apparatus 10 may require to convey a given length (for example, 4 or 5 meters) of the roll sheet 18 until the vibration such that the roll sheet 18 wobbles along the width direction thereof converges and becomes stable. In the past image-forming apparatus 10 shown in FIG. 1, the roll sheet 18 of the given length conveyed from a confirmation of the stable conveyance of the roll sheet 18 by the sheet position sensor 32 to an image formation on the roll sheet 18 by the printer 12 becomes wasteful. This is a waste sheet.

As described above, the vibration such that the sheet of continuous paper wobbles along the width direction thereof occurs when starting the conveyance of the sheet of continuous paper in a case where the sheet of continuous paper is newly set, where exchanging the relating specific parts of the image-forming apparatus, or where the fixing and separation compression operation is performed in the fixing device of the electrophotographic printer. Particularly, the fixing and separation compression operation in the fixing device occurs when power of the image-forming apparatus is switched on or off, so that this often occurs. The waste sheet of the sheet of continuous paper becomes massive which cannot be ignored. This is also an issue of effective use of resources.

The present invention addresses the above-described issues. The present invention has objects to provide an image-forming apparatus that substantially reduces an amount of the waste sheet even if the sheet of continuous paper wobbles along the width direction thereof when starting the conveyance of the sheet of continuous paper, in a case where the sheet of continuous paper is newly set, where exchanging the relating specific parts of the image-forming apparatus, where the fixing and separation compression operation is performed in the fixing device of the electrophotographic printer or the like.

To achieve at least one of the above-described objects, an image-forming apparatus reflecting one aspect of the present invention is an image-forming apparatus that forms an image on a sheet of continuous recording medium, the apparatus comprising an image-forming portion that receives the sheet of continuous recording medium and forms the image on the sheet of continuous recording medium, a sheet position sensor that measures a position of the sheet of continuous recording medium along a width direction thereof, the width direction being perpendicular to a conveying direction of the sheet of continuous recording medium conveyed to the image-forming portion, and a control portion that controls at least one of start time of image-forming operation in the image-forming portion and an image-writing position of the image-forming portion by fixing at least one of the start time of the image-forming operation in the image-forming portion and the image-writing position of the image-forming portion, based on positional measurement data about the position of the sheet of continuous recording medium along the width direction thereof, the positional measurement data being measured by the sheet position sensor.

According to embodiments of the present invention, it is desired to provide the image-forming apparatus wherein the sheet position sensor is positioned at an upstream side of the image-forming portion.

It is further desired to provide the image-forming apparatus wherein the control portion controls the image-forming portion to start forming the image on the sheet of continuous recording medium when determining that a vibration of the sheet of continuous recording medium along the width direction thereof becomes stable based on the positional measurement data from the sheet position sensor.

It is additionally desired to provide the image-forming apparatus wherein the control portion calculates stable time when the vibration of the sheet of continuous recording medium along the width direction thereof becomes stable based on the positional measurement data from the sheet position sensor and controls the image-forming portion to previously start an image-forming preparation operation before the calculated stable time and to start forming the image on the sheet of continuous recording medium from the calculated stable time.

It is still further desired to provide the image-forming apparatus wherein the control portion calculates stable time when the vibration of the sheet of continuous recording medium along the width direction thereof becomes stable and a stable position where the vibration of the sheet of continuous recording medium along the width direction thereof becomes stable, based on the positional measurement data from the sheet position sensor and controls the image-forming portion to previously start an image-forming preparation operation before the calculated stable time and to start forming the image on the sheet of continuous recording medium from the calculated stable time.

It is still additionally desired to provide the image-forming apparatus wherein the control portion reads the positional measurement data from the sheet position sensor for every sheet of continuous recording medium and calculates at least one of the stable time and the stable position.

It is further desired to provide the image-forming apparatus wherein a damping profile relating to damping of the vibration of the sheet of continuous recording medium along the width direction thereof is provided for every species of the sheet of continuous recording medium and for every range of paper weight of the sheet of continuous recording medium, and the control portion calculates at least one of the stable time and the stable position, with referring to the damping profile when conveying the sheet of continuous recording medium.

It is additionally desired to provide the image-forming apparatus wherein the control portion reads the positional measurement data from the sheet position sensor when exchanging parts of the image-forming apparatus relating to the vibration of the sheet of continuous recording medium along the width direction thereof, and the control portion newly sets at least one of the stable time and the stable position.

It is still further desired to provide the image-forming apparatus wherein the control portion calculates at least one of the stable time and the stable position, with referring to setting according to the damping profile, when a fixing portion separates and compresses the sheet of continuous recording medium but parts of the image-forming apparatus relating to the vibration of the sheet of continuous recording medium along the width direction thereof are not exchanged.

It is still additionally desired to provide the image-forming apparatus wherein the control portion controls the image-forming portion to form the image on the sheet of continuous recording medium based on at least one of the stable time and the stable position of an immediately preceding image-forming operation, when a fixing portion does not separate nor compress the sheet of continuous recording medium and parts of the image-forming apparatus relating to the vibration of the sheet of continuous recording medium along the width direction thereof are not exchanged.

Other objects and attainments of the present invention will be become apparent to those skilled in the art upon a reading of the following detailed description when taken in conjunction with the drawing.

DESCRIPTION OF THE PREFERRED EMBODIMENTS

The following will describe preferable embodiments of an image-forming apparatus according to the present invention with reference to the drawings. Such description does not limit the technical scope, meaning of terms and the like in Claims.

Figure 1:
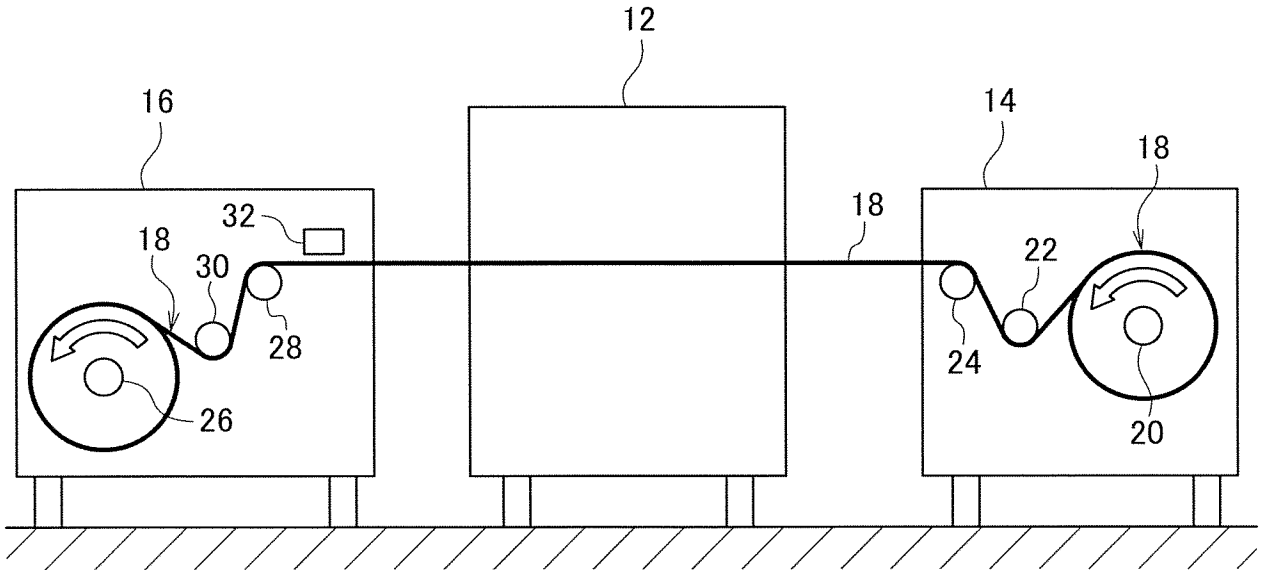
FIG.1 RELATED ART
FIG. 1 is a diagram roughly showing a configuration example of a past image-forming apparatus.
Figure 2:
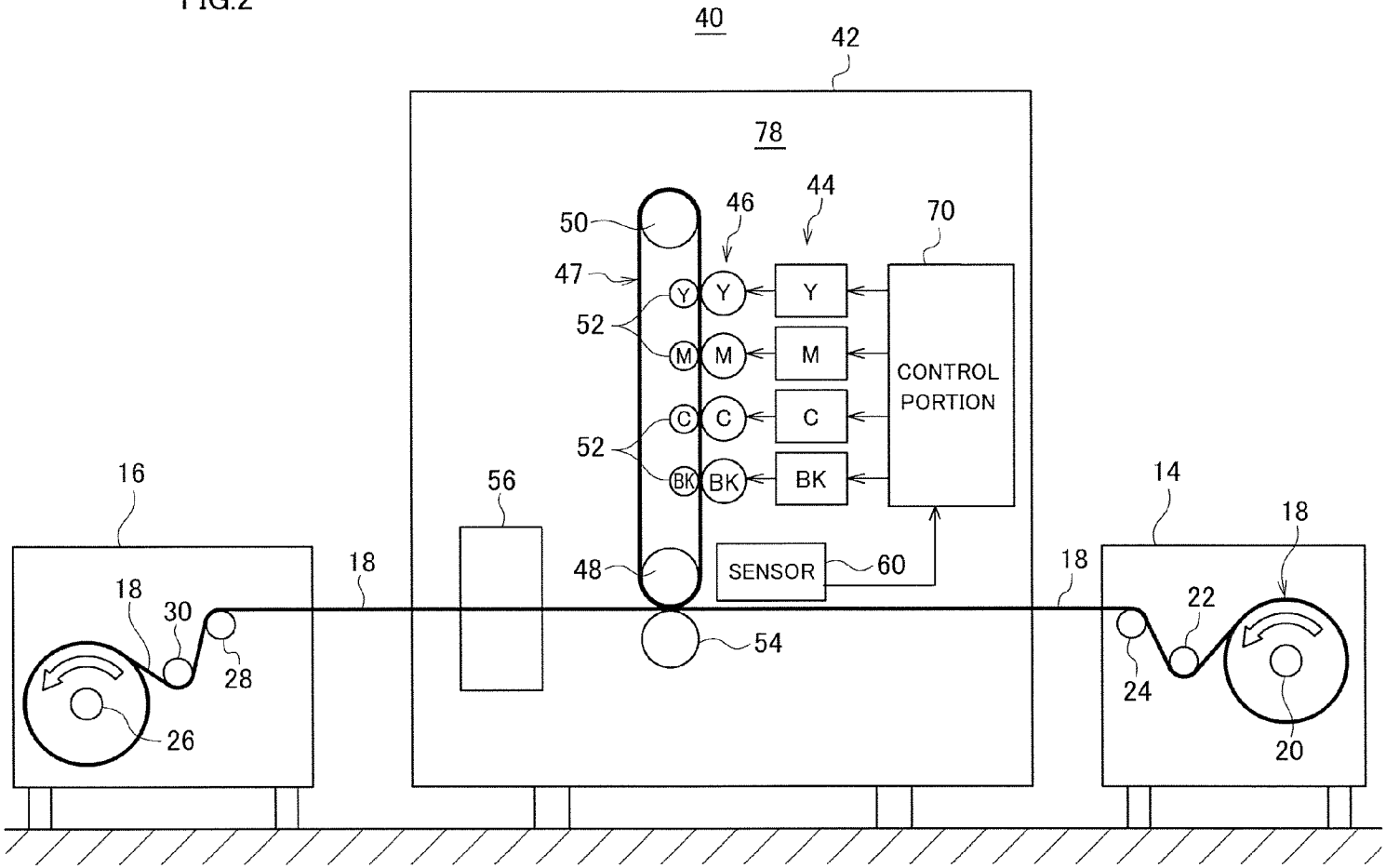
FIG. 2 is a diagram roughly showing a configuration example of an image-forming apparatus according to a first preferable embodiment of this invention.
Figure 3:
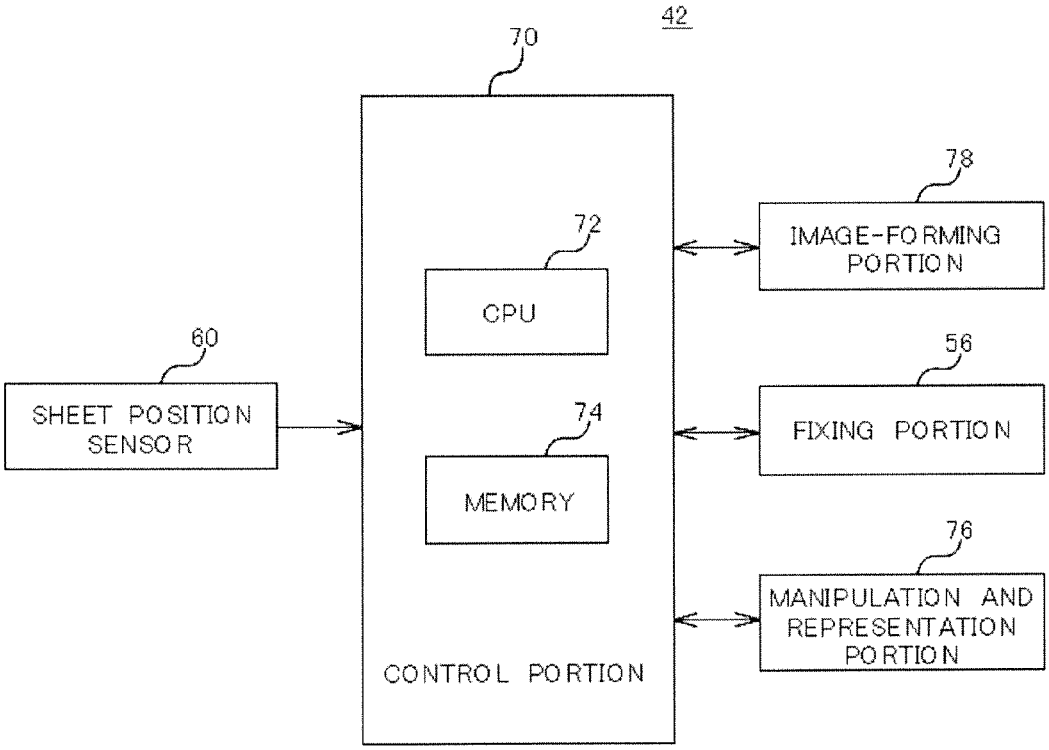
FIG. 3 is a block diagram roughly showing a printer in the image-forming apparatus according to the first preferable embodiment of this invention.

FIG. 2 roughly shows a configuration example of an image-forming apparatus 40 according to a first preferable embodiment of this invention. Like reference numbers shown in FIG. 2 indicate like components shown in FIG. 1. FIG. 3 roughly shows a printer 42 in the image-forming apparatus 40 according to the first preferable embodiment of this invention. The printer 42 is connected with components shown in FIG. 2. It is to be noted that the following will describe a case where a roll sheet 18 is used as an example of the sheet of continuous paper.

The image-forming apparatus 40 includes a feeder 14, the printer 42, a reel 16 and a control portion 70 (see FIG. 3). The feeder 14 may have the same configuration as that of a past feeder and contains a shaft 20 of the roll sheet 18, a tension roller 22 and a guide roller 24. The feeder 14 feeds the roll sheet 18 to the printer 42.

The reel 16 has a configuration which is similar to that of a past reel and contains a reel shaft 26 of the roll sheet 18, a tension roller 30 and a guide roller 28. The reel 16 reels the roll sheet 18 from the printer 42.

The printer 42, in a case of the electrophotographic printer, has a configuration that is similar to that of a past printer. The printer 42 includes four image-forming units, namely, an image-forming unit 44Y which forms a yellow (Y) image, an image-forming unit 44M which forms a magenta (M) image, an image-forming unit 44C which forms a cyan (C) image and an image-forming unit 44K which forms a black (BK) image (hereinafter, simply indicated by "44" without Y, M, C and K). Each image-forming unit 44 contains a photosensitive drum 46Y, a photosensitive drum 46M, a photosensitive drum 46C or a photosensitive drum 46C (hereinafter, simply indicated by "44" without Y, M, C and K). Each image-forming unit 44 also contains a charging portion, an exposing portion and a developing portion, which are not shown.

The exposing portions scan and expose surfaces of the photosensitive drums 46, which have been charged by the charging portions, by laser light based on image signals of Y, M, C and K supplied from the control portion 70 to form electrostatic latent images on the photosensitive drums 46. An intermediate transfer belt 47 is stretched from a roller 48 to a roller 50. Primary transfer rollers 52Y, 52M, 52C and 52K (hereinafter, simply indicated by "52" without Y, M, C and K) are arranged so as to be opposed to the photosensitive drums 46 with the primary transfer rollers 52 and the photosensitive drums 46 nipping the intermediate transfer belt 47. The primary transfer rollers 52 attract the toner images formed on the photosensitive drums 46 in an electrostatic manner to transfer them on the intermediate transfer belt 47 (Primary Transfer).

The toner images transferred on the intermediate transfer belt 47 are then transferred onto the roll sheet 18 nipped between the roller 48 and a secondary transfer roller 54 (Secondary Transfer). A fixing portion 56 fixes the toner images transferred onto the roll sheet 18. Thus, the image formation is completed. The above-mentioned configuration and operation of the printer 42 are similar to those of the past printer, so that the following will not describe the printer 42 more in detail. The image-forming units 44, the photosensitive drums 46, the intermediate transfer belt 47, the secondary transfer roller 54 and the like constitute an image-forming portion 78.

The image-forming apparatus 40 according to the first embodiment of the invention contains a sheet position sensor 60 inside the printer 42, not in the reel 16. This sheet position sensor 60 is preferably arranged at an upstream side of the image-forming portion 78 (the secondary transfer roller 54), namely, a feeder side, along the conveyance direction of the sheet of continuous paper. The sheet position sensor 60 may be arranged at a downstream side of the image-forming portion 78, namely, a reel side. In a case where the sheet position sensor 60 is arranged at the upstream side, only the sheet position sensor 60 is arranged at the upstream side of the printer 42.

The sheet position sensor 60 measures a position of the roll sheet 18 along the width direction thereof and it generates positional measurement data. The sheet position sensor 60 may be line sensors arranged along the width direction of the roll sheet 18 or a video camera. For example, the position of the roll sheet 18 along the width direction thereof may be detected from difference in brightness between an inside and an outside of edge of the roll sheet 18 in image data. The sheet position sensor 60 generates the detected information as positional measurement data. It is to be noted that the width direction of the roll sheet 18 is referred to as a direction which is perpendicular to a conveying direction of the roll sheet 18 in the embodiments of the invention.

The control portion 70 includes a central processing unit (CPU) 72 and a memory 74, which are connected to each other through a bus (see FIG. 3). CPU 72 is a microprocessor, a microcomputer, an application specific integrated circuit or the like. The memory 74 is a hard disk, a read only memory (ROM), a random access memory (RAM) or the like. The memory 74 stores an operating system such as Windows (registered trademark), any programs for controlling operations of the image-forming apparatus 40 and the like. The memory 74 also functions as a temporary storage device.

In the control portion 70, input/output devices, not shown, are connected to the bus. Though the input/output devices, the control portion 70 receives image data from outside, receives the positional measurement data from the sheet position sensor 60, and receives condition data for indicating a condition of the fixing portion 56 and the image-forming portion 78 in the printer 42. A manipulation and representation portion 76 is constituted by any manipulation switches or key board, and representation device. Through the manipulation and representation portion 76, a user can control the printer 42 and the like. The manipulation and representation portion 76 may be a touch panel manipulation portion attached to the printer 42, or any input device of the computer. The control portion 70 also controls the operations of the fixing portion 56 and the image-forming portion 78 based on the above-mentioned program and command data from the manipulation and representation portion 76. The program includes programs for image-forming operations, which will be described later, by this invention.

Figure 4:
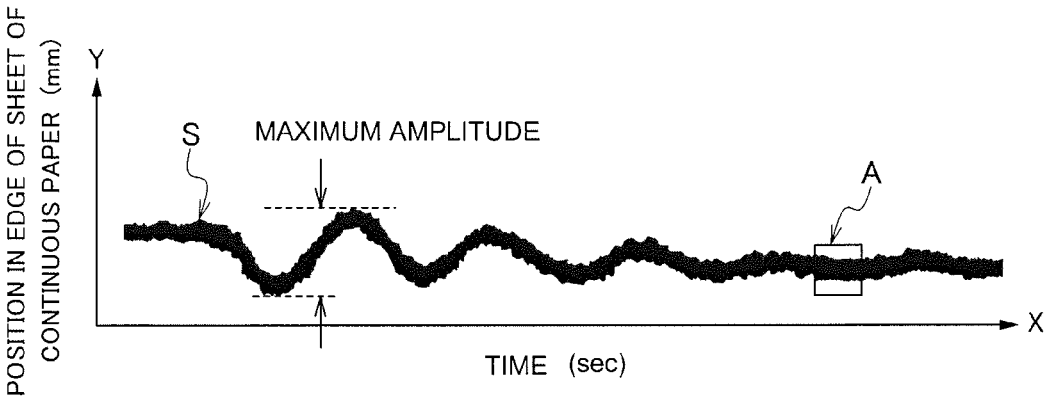
FIG. 4 is a graph showing a relationship between a wobbling width of a sheet of continuous paper and time and illustrating an operation of the image-forming apparatus according to the first preferable embodiment of the invention.

FIG. 4 shows an operation of the image-forming apparatus 40 according to the first embodiment of the invention and illustrates a relationship between a vibration of the roll sheet 18 along the width direction thereof, namely, a position in an edge of the roll sheet 18 (Y-axis; unit is mm) and time (X-axis; unit is second). As described above, when newly setting (conveying) the roll sheet 18, exchanging relating specific parts, performing the fixing and separation compression operation in the fixing device of the electrophotographic printer or the like, any vibration such that the roll sheet 18 wobbles along a width direction thereof may occur at a conveyance start time thereof. In FIG. 4, at a point S, it starts conveying the roll sheet 18. The vibration such that the roll sheet 18 wobbles along the width direction thereof is sinusoidally damped as shown in FIG. 4. The maximum amplitude of this vibration is, for example, 2 mm. It can seem that the vibration converges and becomes stable when the amplitude becomes, for example, 0.2 mm as shown in a region A of FIG. 4. Such time is referred as stable time and a position of the edge of the roll sheet 18 corresponding to this amplitude is referred as a stable position. It finally may aim at the vibration to converge when the amplitude becomes 0.1 mm.

The sheet position sensor 60 sends the positional measurement data as shown in FIG. 4 to the control portion 70. In a first embodiment of the image-forming apparatus 40, the control portion 70 controls the printer 42 to form image (s) following a program stored in a memory according to a flowchart shown in FIG. 5 based on the positional measurement data.

Figure 5:
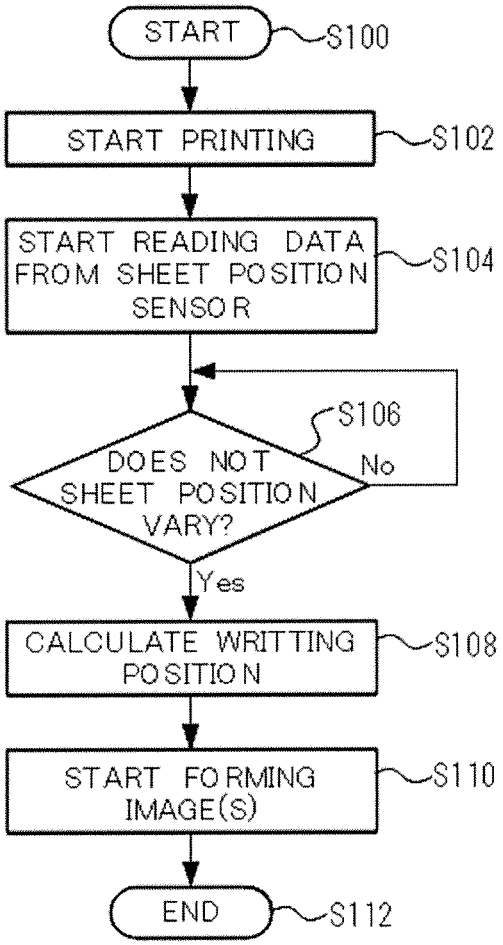
FIG. 5 is a flowchart showing an example of the operation of the image-forming apparatus according to the first preferable embodiment of the invention.

At a step, S100 of FIG. 5, when a user turns on a power switch of the image-forming apparatus 40, the control portion 70 starts an operation of the printer 42. When the user pushes, for example, a print start button in the manipulation and representation portion 76, the control portion 70 controls the printer 42 to start printing and starts conveying the roll sheet 18, at a step, S102. At a step, S104, the sheet position sensor 60 successively measures a position of the roll sheet 18 along the width direction thereof and successively sends the positional measurement data as shown in FIG. 4 to the control portion 70. It is to be noted that FIG. 4 shows the positional measurement data as an analogue wave but in fact, FIG. 4 shows the positional measurement digital data corresponding thereto.

At a step, S106, the control portion 70 processes the positional measurement data and determines whether or not the sheet position does not vary based on a result of the processing. If the sheet position varies, namely, in a No case of the step, S106, the control portion 70 returns to a start of the step, S106 to perform the processing of the step, S106 until the sheet position sensor 60 detects that the sheet position does not vary. It means that amplitude of variation in the position of the roll sheet 18 along the width direction thereof damps to, for example, 0.2 mm or less, like the above-mentioned description referring to FIG. 4 that the sheet position does not vary. This damping value of 0.2 mm or less may be 0.1 mm or less ultimately. If the sheet position sensor 60 detects that the sheet position does not vary, namely, in a YES case of the step, S106, the control portion 70 goes to a step, S108.

At the step, S108, the control portion 70 processes the positional measurement data and obtains a value of the sheet position when the sheet position does not vary, for example, an amplitude value at the region A shown in FIG. 4. This amplitude value shows a position of the roll sheet 18 along the width direction thereof when the roll sheet 18 is conveyed in the printer 42. The amplitude value indicates a stable position of the roll sheet 18. Since the sheet of continuous paper may be stable with it being shifted along the width direction thereof, it is required to obtain the stable position. The control portion 70 calculates a writing (image-forming) position of the roll sheet 18 along a main scanning direction thereof on the basis of the stable position.

Further, there may be a case where, even if the control portion 70 starts forming the image when the vibration of the roll sheet 18 along the width direction thereof becomes within an allowable range, it is too late for the image formation when the vibration completely converges. Accordingly, taking such a case into consideration, the control portion 70 may calculates only the writing position, at the step, S108, without predicting the start time of image-forming operation, which will be described later. If the step, S108 finishes, the control portion 70 goes to a step, S110. At the step, S110, the control portion 70 sends an image-forming start signal and image data of an image to be formed to the printer 42. The printer 42 starts the above-mentioned image-forming operation based on these signal and data to form (or print) the image corresponding to the image data on the roll sheet 18.

In the past image-forming apparatus shown in FIG. 1, the sheet position sensor is arranged in the reel so that when confirming in the reel that the variation of the position of the sheet of continuous paper along the width direction thereof becomes stable, the conveyance of the sheet of continuous paper is stable at upstream side of the reel. A part of the sheet of continuous paper between the reel and the printer 42 becomes waste sheet nevertheless the position of the sheet of continuous paper along the width direction thereof is stable. On the other hand, according to this invention, since the sheet position sensor 60 is arranged near the secondary transfer roller 54 (secondary transfer portion), it is possible to reduce an amount of waste sheet. This is because a part of the roll sheet 18 between the sheet position sensor 60 and the printer 42 is short when confirming that the variation of the position of the sheet of continuous paper along the width direction thereof becomes stable.

Further, it is possible to reduce a more amount of waste sheet by arranging the sheet position sensor 60 at the upstream side of the image-forming portion 78 (secondary transfer portion). When the sheet position sensor 60 is arranged at the upstream side of the printer 42, there may be a case where the conveyance of the roll sheet 18 is not yet stable at a position of the printer 42 which is positioned at a downstream side of the sheet position sensor 60 even when the conveyance of the roll sheet 18 is stable at a position of the sheet position sensor 60. This, however, does not matter because a distance between the sheet position sensor 60 and the printer 42 is short and it takes some time from a time confirming that the sheet position does not vary to the start time of image-forming operation.

Figure 6:
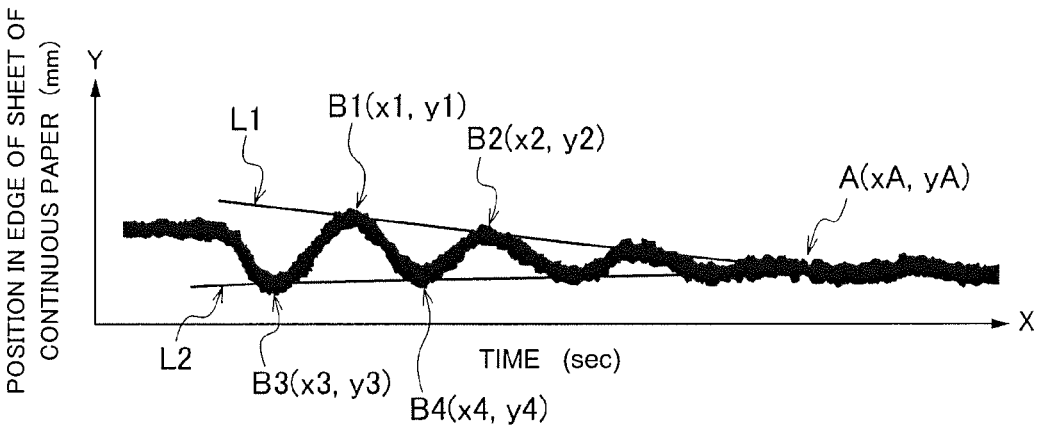
FIG. 6 is a graph showing a principle for predictively calculating stable time of the sheet of continuous paper and a stable position thereof from a relationship between the wobbling width of the sheet of continuous paper and time and illustrating an operation of the image-forming apparatus according to a second preferable embodiment of the invention.

The following will describe a second preferable embodiment of the image-forming apparatus. A method to control an image-forming (printing) operation of the printer 42 by calculating a stable time of the roll sheet 18 and a stable position thereof based on the positional measurement data from the sheet position sensor 60 before the vibration of the roll sheet 18 along the width direction thereof becomes actually stable will be described. In order to perform such a method, it is required to previously obtain a damping profile relating to damping of the vibration of the sheet of continuous paper along the width direction thereof for every species of the roll sheet 18 and for every range of paper weight of the roll sheet 18 before the calculation of the stable time of the roll sheet 18 and the stable position thereof. FIG. 6 illustrates a principle for predictively calculating the stable time of the roll sheet 18 and the stable position thereof from a relationship between the wobbling width of the roll sheet 18 and time. A damping wave which is similar to that shown in FIG. 4 is used for this.

In FIG. 6, a point A (X coordinate is xA, and Y coordinate is yA) of the damping wave is a convergence point in which a vibration of the roll sheet 18 along the width direction thereof becomes stable. The value xA along a direction of a time axis indicates the stable time and the value yA along a direction of a sheet edge position axis indicates the stable position. A straight line L1 passing through points of inflection B1 (x1, y1), B2 (x2, y2) and the point A (xA, yA) in the damping wave can be represented by an equation, $y=ax+b$ . . . (1). Similarly, a straight line L2 passing through points of inflection B3 (x3, y3), B4 (x4, y4) and the point A (xA, yA) in the damping wave can be represented by an equation, $y=cx+d$ . . . (2). Thus, the stable point A is a point of intersection between the straight lines L1 and L2. Inclinations (a, c) in the equations (1) and (2) are referred as "damping profile".

When obtaining the points of inflection B1 through B4 and the stable point A from the positional measurement data for every species of the roll sheet 18 and for every range of paper weight of the roll sheet 18, the values a, b of the straight line L1 and the values c, d of the straight line L2 can be previously obtained. For example, in a following Table TB, when the species of sheet of the roll sheet 18 is plain paper and the paper weight of the roll sheet 18 is 136 through 176 g/m$^2$, the damping profile thereof is (a1, c1); When the species of sheet of the roll sheet 18 is coated paper and the paper weight of the roll sheet 18 is 177 through 216 g/m$^2$, the damping profile thereof is (a2, c2); When the species of sheet of the roll sheet 18 is tacky paper and the paper weight of the roll sheet 18 is 136 through 176 g/m2, the damping profile thereof is (a3, c3); When the species of sheet of the roll sheet 18 is tacky PET film and the paper weight of the roll sheet 18 is 136 through 176 g/m2, the damping profile thereof is (a4, c4).

TABLE TB

| Species of Sheet | Paper Weight (g/m$^2$) | Damping Profile (Inclinations) |
|---|---|---|
| Plain Paper | 136 through 176 | (a1, c1) |
| Coated Paper | 177 through 216 | (a2, c2) |
| Tacky Paper | 136 through 176 | (a3, c3) |
| Tacky PET Film | 136 through 176 | (a4, c4) |

These damping profiles may be stored in the memory 74 of the control portion 70 as the table TB at a factory shipment time of the printer 42. The above table TB is an example of a table in which the species of sheet and the paper weight correspond to the damping profile. By referring to the table TB, it is possible to easily obtain the damping profile from the species of sheet and the paper weight. Further, regarding the damping profile of the sheet which is not stored in the memory, the control portion 70 can obtain it by analyzing positional measurement data from the sheet position sensor 60 and update the memory 74 to store it.

When obtaining the damping profile of the roll sheet 18, the control portion 70 can calculate the straight lines L1 and L2 by obtaining the coordinates of the points of inflection B1 through B4 from the positional measurement data from the sheet position sensor 60. Accordingly, when obtaining the positional measurement data up to, for example, the point of inflection B2 before the damping wave becomes stable, it is possible to predictively calculate the coordinates of the stable point A after the point of inflection B2.

Figure 7:
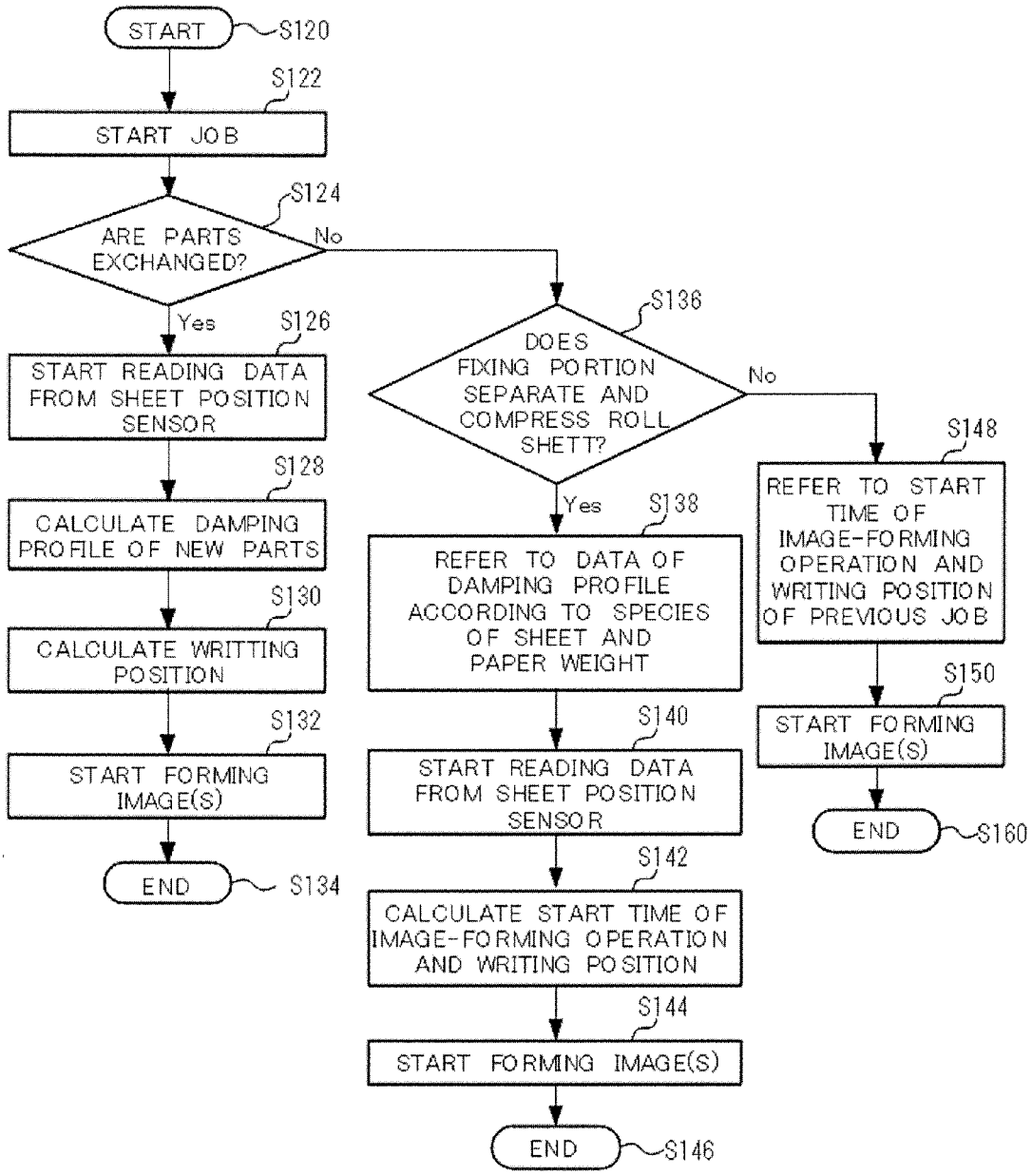
FIG. 7 is a flowchart showing an example of an operation of the image-forming apparatus according to the second preferable embodiment of the invention.

The following will describe the second embodiment of the image-forming apparatus using the above-mentioned prediction principle with reference to a flowchart shown in FIG. 7. CPU 72 controls the operation according to this flowchart in connection with a program stored in the memory 74.

At a step, S120, when a user turns on a power switch of the image-forming apparatus 40, the control portion 70 starts the operation of the image-forming apparatus 40.

At a step, S122, the control portion 70 starts a job by starting up the program relating to the image formation.

At a step, S124, the control portion 70 determines whether or not parts relating to a vibration of the roll sheet 18 along the width direction thereof are exchanged. Here, any expendables such as the secondary transfer roller 54 and the fixing portion 56 are specifically illustrated as the parts. When exchanging the parts, the memory 74 stores parts-exchanging historical data so that it is possible to determine whether or not the parts have been exchanged by referring to the parts-exchanging historical data.

If it is determined that the parts are exchanged at the step, S124, namely, in a YES case, the control portion 70 goes to a step, S126 where the control portion 70 starts reading the positional measurement data from the sheet position sensor 60 when conveying the roll sheet 18. The step, S126 is similar to the step, S104, which has been described in detail with reference to FIG. 5, so that the description of the step, S126 will be omitted. The control portion 70 then goes to a step, S128 where the damping profile of new parts is again calculated. This calculation is also performed using a method that is similar to the above-mentioned method of obtaining the damping profile with reference to FIG. 6. Old damping profile is updated to an obtained new damping profile in the memory 74. Here, since previous damping profile cannot be used, the stable time and the stable position cannot be predicted.

The control portion 70 then goes to a step, S130 where the control portion 70 calculates a writing position of the roll sheet 18. The control portion 70 then goes to a step, S132 where the control portion 70 starts forming the image. The control portion 70 finally goes to a step, S134 where the control portion 70 completes the operation thereof. These steps, S130 and S132 are similar to the steps, S108 and S110, which have been described in detail with reference to FIG. 5, so that the description of the steps, S130 and S132 will be omitted.

If it is determined that the parts are not exchanged at the step, S124, namely, in a NO case, the control portion 70 goes to a step, S136. At the step, S136, the control portion 70 determines whether or not the fixing portion 56 separates and compresses the roll sheet 18 before the job starts. This is because the position of the roll sheet 18 is shifted along the width direction thereof when the fixing portion 56 compresses the roll sheet 18 even if the fixing portion 56 is stable in the non-fixing state so that the fixing portion 56 cannot perform any suitable operation when the fixing portion 56 is stable in the fixing state. If it is determined that the fixing portion 56 separates and compresses the roll sheet 18, namely, in a YES case of the step, S136, the control portion 70 goes to a step, S138 where the data of the damping profile according to the species of sheet and paper weight of the roll sheet 18, which is now set, are read out of the memory 74 and referred.

The control portion 70 then goes to a step, S140 where the control portion 70 starts reading the positional measurement data from the sheet position sensor 60, which is similar to a case of the step, S126. For example, the control portion 70 reads the positional measurement data of the points of inflection B1 through B4 as shown in FIG. 6.

The control portion 70 then goes to a step, S142 where, as described with reference to FIG. 6, the control portion 70 obtains data of the stable time xA and the stable position yA of the stable point Abased on the damping profile and the positional measurement data before the vibration of the roll sheet 18 along the width direction thereof becomes stable, namely, at time of the point of inflection B2 before the stable point A shown in FIG. 6. At the step, S142, the control portion 70 further calculates start time of the image-forming operation and a writing position from the data of the stable time xA and the stable position yA considering operation properties of the printer 42. In other words, the control portion 70 can predict the time and position to be converged before the damping of the vibration of the roll sheet 18 along the width direction thereof, which is indicated by the positional measurement data, actually converges and can form or print the image on the roll sheet 18 itself without any waiting time from the actual converged time.

The control portion 70 then goes to a step, S144 where the control portion 70 starts forming the mage. At the step, S144, the control portion 70 performs a preparation operation of the image formation before the damping vibration of the roll sheet 18 along the width direction thereof actually converges. Namely, the exposing portion exposes a surface of each of the photosensitive drums 46 to form an electrostatic latent image thereon. The toner images corresponding to the electrostatic latent images are transferred to the intermediate transfer belt 47. These operations are performed before the damping vibration of the roll sheet 18 along the width direction thereof actually converges. When reaching a stable time when the damping vibration of the roll sheet 18 along the width direction thereof converges, the toner images transferred to the intermediate transfer belt 47 are directly transferred to the roll sheet 18 to form the image. At a step, S146, the control portion 70 finishes forming the image on the roll sheet 18. Thus, according to this embodiment of the invention, it is possible to substantially reduce an amount of waste sheet.

If it is determined that the fixing portion 56 does not separate and compress the roll sheet 18, namely, in a NO case of the step, S136, the control portion 70 goes to a step, S148. When any parts are not exchanged and the fixing portion 56 does not separate and compress the roll sheet 18, a situation of immediately preceding image-forming operation remains unchanged. Therefore, at the step, S148, the data relating to the start time of the image formation operation and the writing position of previous job, which is store in the memory 74, is referred. The control portion 70 then goes to a step, S150 where it starts forming the image, which is similar to that of the step, S144, based on the data relating to the start time of the image-forming operation and the writing position, which is referred at the step, S148. The control portion 70 then goes to a step, S160 where the control portion 70 finishes forming the image on the roll sheet 18. Thus, according to these steps, S148 and S150, it is also possible to substantially reduce an amount of waste sheet.

Although a case where the damping profile can be obtained by referring to the table TB has been described, the damping profile may be calculated in real time according to a relative equation considering the species of sheet and the paper weight.

The following will describe a third preferable embodiment of the image-forming apparatus. The stable time of the roll sheet 18 generally varies according to a size of the image data.

Figure 8A:
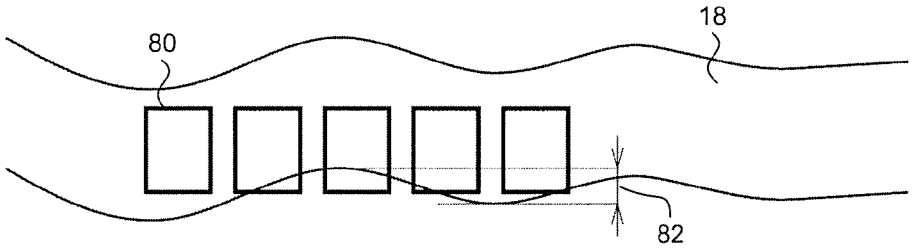
FIG. 8A is a diagram showing a relationship between a wobbling width of a sheet of continuous paper and image data according to a third preferable embodiment of the invention.

FIG. 8A shows a relationship between a wobbling width 82 of the roll sheet 18 and the image data when a length of the image 80 according to the image data along the width direction thereof is longer than that of the image 80 according to the image data along a direction that is perpendicular to the width direction thereof (hereinafter, referred to as "length direction").

When the length of the image 80 along the width direction thereof is longer than that of the image 80 along the length direction thereof, the image 80 may protrude from the roll sheet 18 by any influence of the wobbling of the roll sheet 18, as shown in FIG. 8A.

Figure 8B:
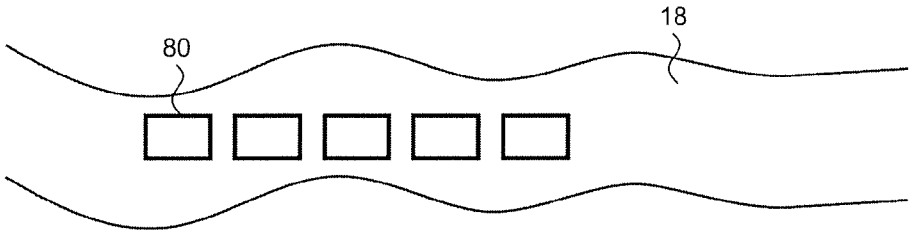
FIG. 8B is a diagram showing a relationship between a wobbling width of a sheet of continuous paper and image data according to the third preferable embodiment of the invention.

FIG. 8B shows a relationship between a wobbling width 82 of the roll sheet 18 and the image data when a length of the image 80 according to the image data along the width direction thereof is shorter than that of the image 80 according to the image data along the length direction thereof.

When the length of the image 80 along the width direction thereof is shorter than that of the image 80 along the length direction thereof, the image 80 does not protrude from the roll sheet 18 without receiving any influence of the wobbling of the roll sheet 18, as shown in FIG. 8B.

Thus, the stable time of the roll sheet 18 varies according to the size of the image data. In the third preferable embodiment, the control portion 70 controls the start time of the image-forming operation on the roll sheet 18 by the printer 42 based on the size of the image data along the width direction thereof.

Figure 9:
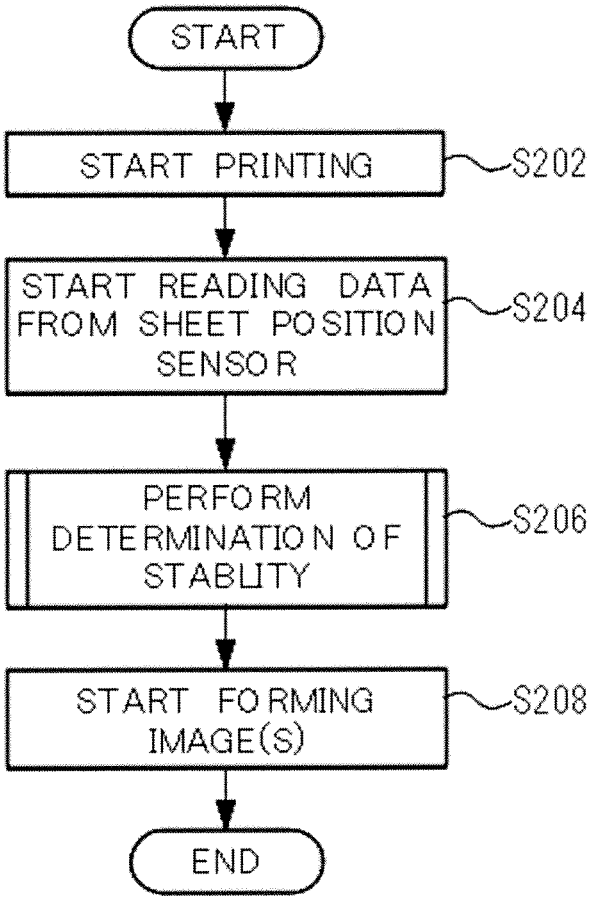
FIG. 9 is a flowchart showing an example of an operation of the image-forming apparatus according to the third preferable embodiment of the invention.

FIG. 9 shows an example of an operation of the image-forming apparatus according to the third preferable embodiment of the invention to control the start time of the image-forming operation on the roll sheet 18 by the printer 42.

When a user turns on a power switch of the image-forming apparatus 40, the control portion 70 starts the operation of the image-forming apparatus 40. At a step, S202 of FIG. 9, when the user pushes a print start button in the manipulation and representation portion 76, the control portion 70 controls the printer 42 to start printing the image and controls the feeder 14 to start feeding the roll sheet 18.

At a step, S204, the control portion 70 starts reading the positional measurement data from the sheet position sensor 60. Specifically, the sheet position sensor 60 successively measures a position of the roll sheet 18 along the width direction thereof and successively sends the positional measurement data to the control portion 70.

At a step, S206, the control portion 70 performs determination of stability. This determination of stability is a process for determining whether or not an image can be formed without any protrusion of the image 80 from the roll sheet 18 based on the positional measurement data and the image data. The determination of stability will be described later.

After it is determined that the image can be formed at the step, S206, the control portion 70 goes to a step, S208 where the control portion 70 sends an image-forming start signal and the image data to the printer 42. The printer 42 then starts the above-mentioned printing operation. Thus, the control portion 70 then finishes this operation.

Figure 10:
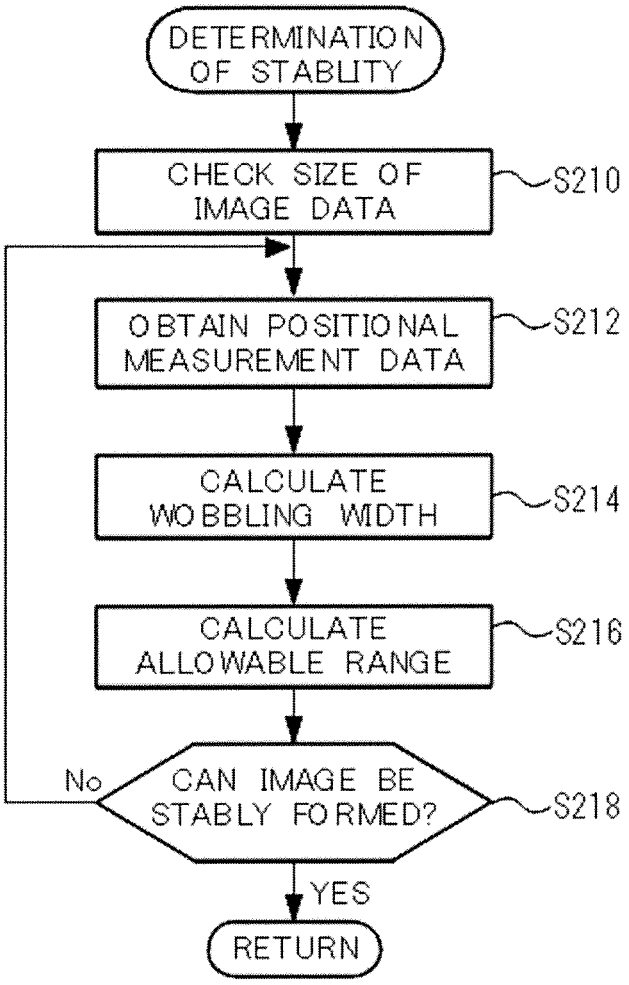
FIG. 10 is a flowchart showing a subroutine of determination of stability.

FIG. 10 shows a subroutine of the determination of stability according to the third preferable embodiment of the invention. The control portion 70 substantially performs this subroutine.

At a step, S210 of FIG. 10, the control portion 70 checks a size of image data. The control portion 70 obtains the size of image data along a width direction of the image which is perpendicular to the conveying direction of the roll sheet 18 based on the image data received from outside.

At a step, S212, the control portion 70 obtains the positional measurement data. Specifically, the control portion 70 obtains the positional measurement data from the sheet position sensor 60.

At a step, S214, the control portion 70 calculates a wobbling width 82 of the roll sheet 18. The control portion 70 calculates the wobbling width 82 of the roll sheet 18 based on the obtained positional measurement data shown in FIG. 4.

At a step, S216, the control portion 70 calculates an allowable range. As an example of the allowable range, for example, the allowable range may be a length which subtracts the wobbling width 82 of the roll sheet 18 from a width of the roll sheet 18.

At a step, S218, the control portion 70 determines whether or not the image can be stably formed. It is specifically determined whether or not the image can be formed without any protrusion of the image 80 from the roll sheet 18. Accordingly, it is possible to determine whether or not the image can be formed without any protrusion of the image 80 from the roll sheet 18 according to whether or not the length of the image according to the image data along the width direction thereof stays within the calculated allowable range.

If it is determined that the image can be stably formed at the step, S218, namely, in a YES case of the step, S218, the control portion 70 goes to the step, S208 where control portion 70 starts forming the image.

If it is determined that the image can be not stably formed, namely, in a NO case of the step, S218, the control portion 70 returns to the step, S212 and repeats the processing until the image can be stably formed.

The above-mentioned wobbling width 82 is sinusoidally damped, so that the allowable range is enlarged. Therefore, it is determined that the image can be soon formed if the length of the image 80 according to the image data along the width direction thereof is shorter than that of the image 80 according to the image data along the length direction thereof. On the other hand, it is determined that the image can be formed when the wobbling width 82 becomes small if the length of the image 80 according to the image data along the width direction thereof is longer than that of the image 80 according to the image data along the length direction thereof.

In the image-forming apparatus according this embodiment, start time of image-forming operation is controlled on the basis of the positional measurement data, which is measured by the sheet position sensor 60, and the image data. Specifically, it is possible to reduce an amount of waste sheet because it is determined that the image can be soon formed from the start of the conveyance of the roll sheet 18 if the length of the image 80 according to the image data along the width direction thereof is shorter than that of the image 80 according to the image data along the length direction thereof. On the other hand, it is determined that the image can be formed when the wobbling width 82 becomes small if the length of the image 80 according to the image data along the width direction thereof is longer than that of the image 80 according to the image data along the length direction thereof so that it is possible to maintain an image quality without any protrusion of the image from the roll sheet 18.

Although the calculation of the allowable range has been described on the basis of the calculated result of the wobbling width 82 of the roll sheet 18 in this embodiment, threshold values of the wobbling width 82 for stably forming the image may be respectively set in cases where the length of the image 80 according to the image data along the width direction thereof is longer and shorter than that of the image 80 according to the image data along the length direction thereof.

For example, if the length of the image 80 according to the image data along the width direction thereof is longer than that of the image 80 according to the image data along the length direction thereof, it may be determined that the image is stably formed when the wobbling width 82 of the roll sheet 18 stays below a first threshold value T1. If the length of the image 80 according to the image data along the width direction thereof is shorter than that of the image 80 according to the image data along the length direction thereof, it may be determined that the image is stably formed when the wobbling width 82 of the roll sheet 18 stays below a second threshold value T2 that is larger than the first threshold value T1 (T2>T1).

Although the calculation of the allowable range has been described on the basis of the calculated result of the wobbling width 82 of the roll sheet 18 in this embodiment, it is possible to estimate the stable time, not calculate the allowable range, and to determine that the image can be formed when such stable time elapses.

For example, if the length of the image 80 according to the image data along the width direction thereof is longer than that of the image 80 according to the image data along the length direction thereof, it may be determined that the image is stably formed when a first period of time TA1 elapses. If the length of the image 80 according to the image data along the width direction thereof is shorter than that of the image 80 according to the image data along the length direction thereof, it may be determined that the image is stably formed when a second period of time TA2, which is shorter than the first period of time TA1 (TA2<TA1), elapses. The first and second periods of time TA1, TA2 are adjustable based on the calculated wobbling width 82 of the roll sheet 18. For example, the first and second periods of time are adjustable by determining that a period of damping time is extended when the wobbling width 82 of the roll sheet 18 is large but the period of damping time is shortened when the wobbling width 82 of the roll sheet 18 is small. Namely, if the length of the image 80 according to the image data along the width direction thereof is shorter than that of the image 80 according to the image data along the length direction thereof, the stable time is set to be short (namely, the image-forming operation is soon started) as compared by the case where the length of the image 80 according to the image data along the width direction thereof is longer than that of the image 80 according to the image data along the length direction thereof, so that it is possible to reduce an amount of waste sheet. If the length of the image 80 according to the image data along the width direction thereof is longer than that of the image 80 according to the image data along the length direction thereof, the stable time is set to be long (namely, the image-forming operation is late started) as compared by the case where the length of the image 80 according to the image data along the width direction thereof is shorter than that of the image 80 according to the image data along the length direction thereof, so that it is possible to maintain an image quality without any protrusion of the image from the roll sheet 18.

Figure 11:
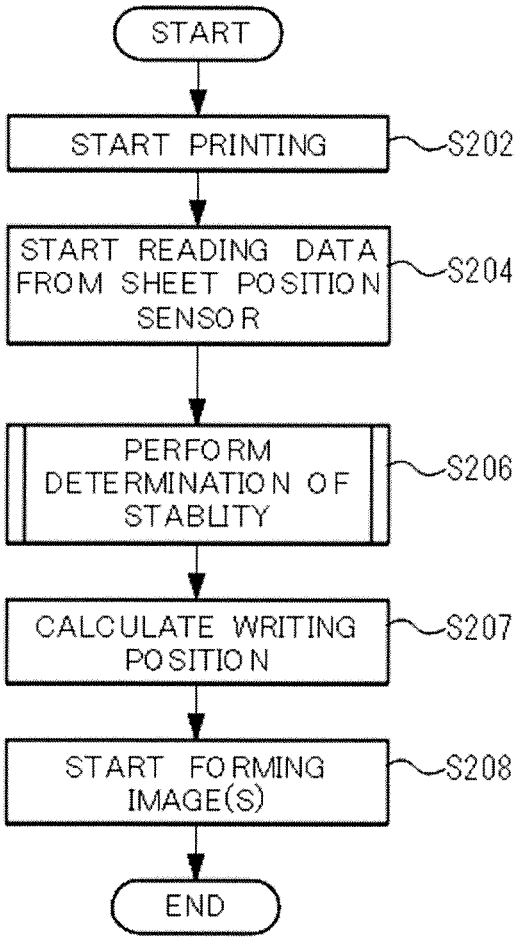
FIG. 11 is a flowchart showing an example of an operation of the image-forming apparatus according to a fourth preferable embodiment of the invention.

The following will describe a fourth preferable embodiment of the image-forming apparatus. FIG. 11 shows an example of an operation of the image-forming apparatus according to the fourth preferable embodiment of the invention.

The flowchart of the fourth preferable embodiment of the invention shown in FIG. 11 is different from that of the third preferable embodiment of the invention shown in FIG. 9 in that a step, S207 is added. The other steps are similar, the description of which will be omitted.

At the step, S207, the control portion 70 calculates a writing position after the determination of stability. The control portion 70 processes the positional measurement data and calculates a writing (image-forming) position of the roll sheet 18 along a main scanning direction thereof corresponding to any variation in the sheet position.

At the step, S208, the control portion 70 starts forming the image. According to the fourth preferable embodiment of the invention, it is possible to put the image firmly in a set position from the edge of the roll sheet 18 even if the roll sheet 18 wobbles along the width direction thereof.

FIGS. 12A through 12D illustrate relationships between wobbling of the roll sheet 18 along the width direction thereof and image data according to the fourth preferable embodiment of the invention.

Figure 12A:
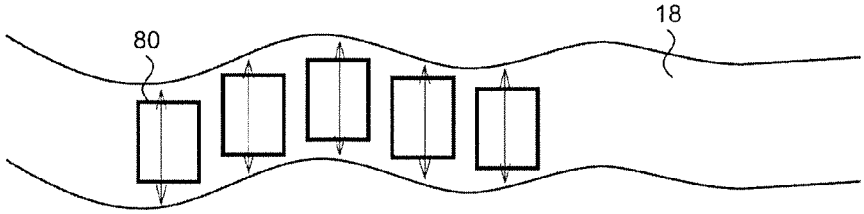
FIG. 12A is a diagram showing a relationship between wobbling of a sheet of continuous paper and image data according to the fourth preferable embodiment of the invention.
Figure 12B:
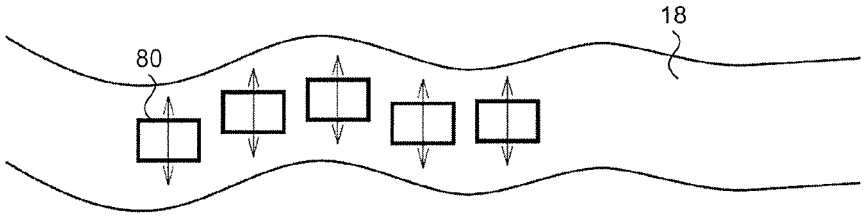
FIG. 12B is a diagram showing a relationship between the wobbling of a sheet of continuous paper and image data according to the fourth preferable embodiment of the invention.

FIGS. 12A and 12B illustrate cases where the length of the image 80 according to the image data along the width direction thereof is longer and shorter than that of the image 80 according to the image data along the length direction thereof, as described with reference to FIGS. 8A and 8B.

As shown in FIGS. 12A and 12B, when calculating writing positions of the images corresponding to the wobbling width 82 of the roll sheet 18 along the width direction thereof and starting forming the images, the images do not protrude from the roll sheet 18 because the images are formed corresponding to the wobbling of the roll sheet 18.

Figure 12C:
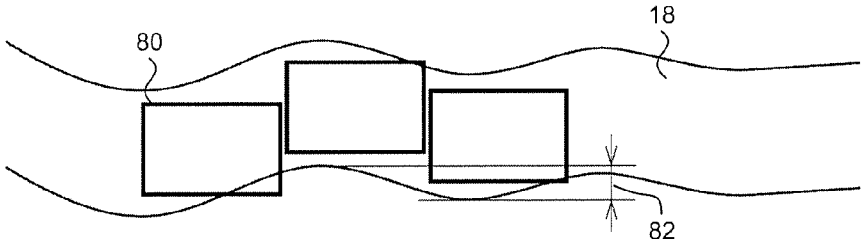
FIG. 12C is a diagram showing a relationship between the wobbling of a sheet of continuous paper and image data according to the fourth preferable embodiment of the invention.

On the other hand, as shown in FIG. 12C, when both of the lengths of the image 80 according to the image data along the width and length directions thereof are long (namely, large size), the image may protrude from the roll sheet 18 by receiving any influence of the wobbling of the roll sheet 18.

Figure 12D:
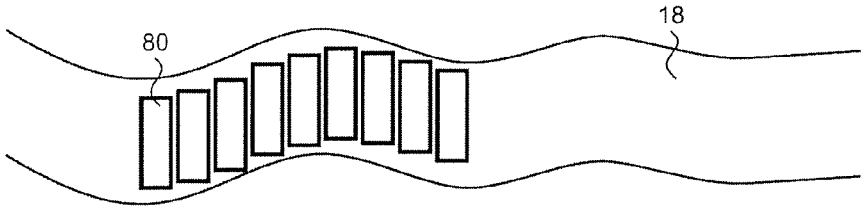
FIG. 12D is a diagram showing a relationship between the wobbling of a sheet of continuous paper and image data according to the fourth preferable embodiment of the invention.

As shown in FIG. 12D, when the length of the image 80 according to the image data along the width directions thereof is long but the length of the image 80 according to the image data along the length direction thereof is short, the image does not protrude from the roll sheet 18 without receiving any influence of the wobbling of the roll sheet 18.

Therefore, the stable time varies based on the size of the image data. In the fourth preferable embodiment, the control portion 70 controls the start time of the image-forming operation on the roll sheet 18 based on the size of the image data along the width and length directions thereof.

Figure 13:
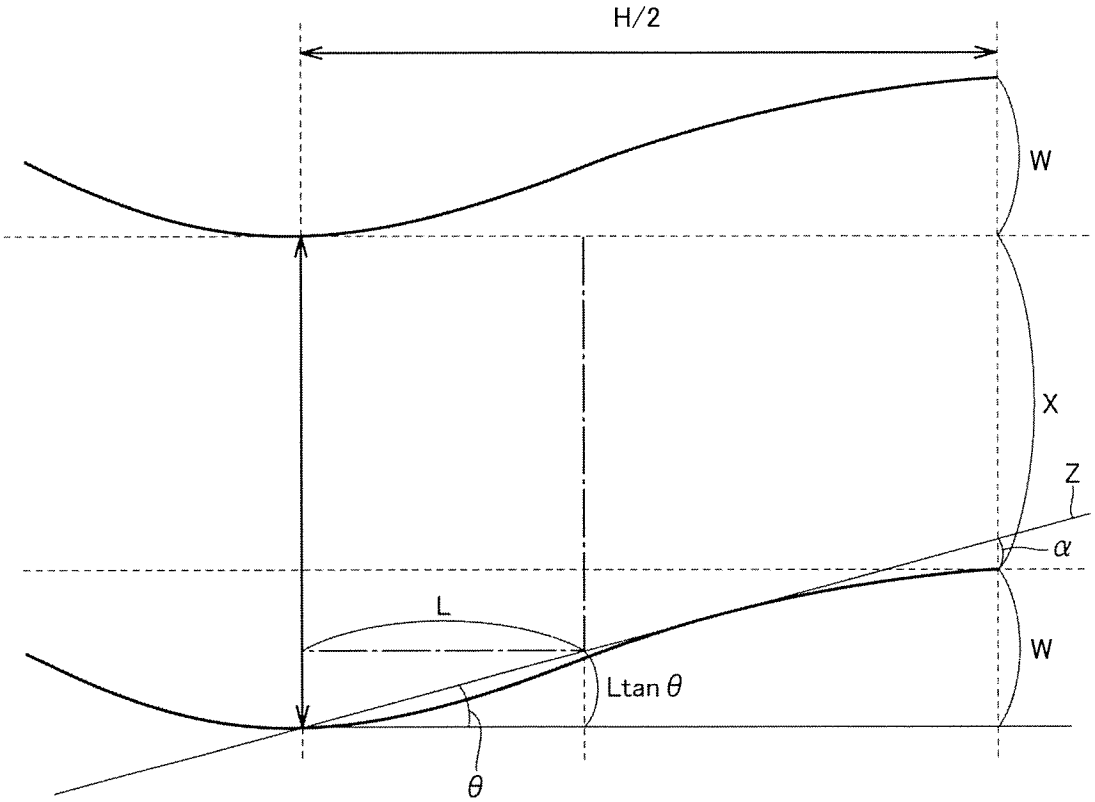
FIG. 13 is a diagram illustrating a case for calculating an allowable range based on a size of the image data according to the fourth embodiment of the invention.

FIG. 13 shows a case for calculating the allowable range based on the size of the image data according to the fourth embodiment of the invention.

As shown in FIG. 13, an approximate line Z which approximates the wobbling line of the edge of the roll sheet 18 is calculated.

Based on the approximate line Z, a size of allowable image data is calculated. For example, when the roll sheet 18 wobbles with the wobbling width W, the image having the length X, which subtracts the wobbling widths W from the width of the roll sheet 18, or less along the width direction thereof does not protrude from the roll sheet 18 because the image does not receive any influence of the wobbling of the roll sheet 18, regardless of the length of image.

On the other hand, when the image has the length L along the length direction thereof, it is considered that if an image has a length along the width direction thereof within the allowable range, $(X+W)-L \tan \Theta$ or less, the image does not protrude from the roll sheet 18 because the image does not receive any influence of the wobbling of the roll sheet 18. As one example, $\tan \Theta=(W+\alpha)/$(a length of a half wobbling cycle). Here, $\alpha$ is a given value.

The length of the half wobbling cycle is calculated by multiplying writing speed with the half wobbling cycle H/2. H is a wobbling cycle. The wobbling of the roll sheet 18 is sinusoidally damped, so that the allowable range is enlarged. It is determined that the image can be stably formed when the size of the image stays within the allowable range of the image size in relation to the wobbling of the roll sheet 18 based on the size of the image data.

The image-forming apparatus 40 according to the fourth embodiment of the invention controls start time of image-forming operation based on the positional measurement data measured by the sheet position sensor 60 and the image data (along the width and length directions). It is possible to reduce an amount of waste sheet by the image-forming apparatus 40 according to the fourth embodiment of the invention because it is determined that the image can be soon stably formed when the allowable range is calculated on the basis of the length of image according to the image data along the width direction thereof and the size of the image stays within the allowable range.

Figure 14B:
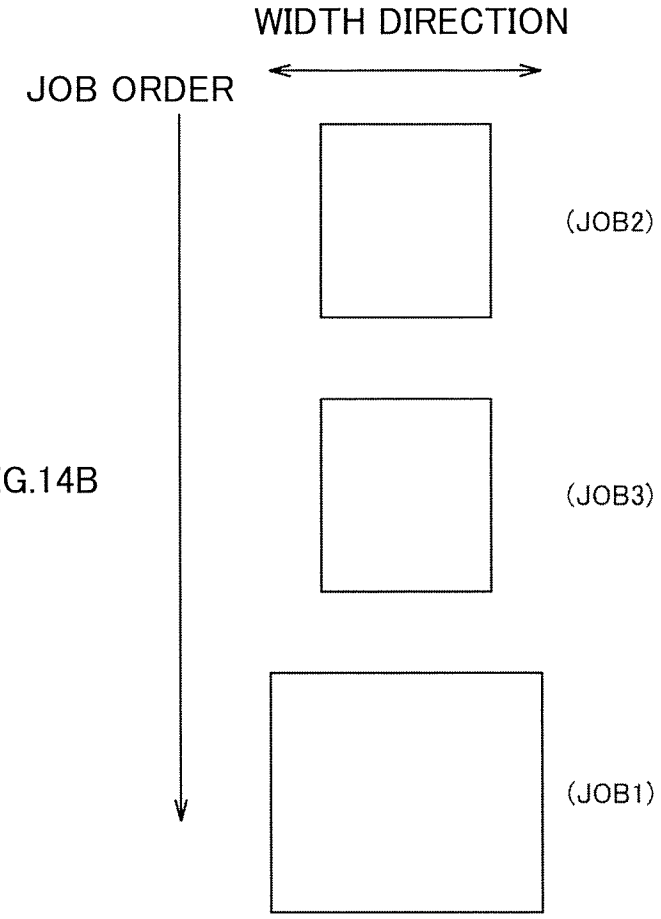
FIG. 14B is a diagram showing a job order after the sort in the fifth preferable embodiment of the image-forming apparatus.
Figure 14A:
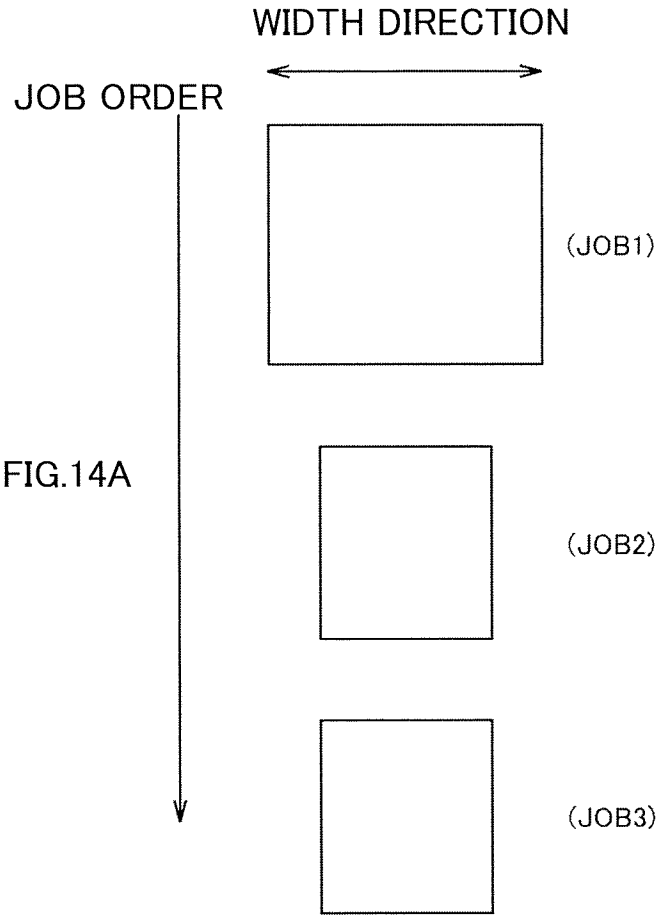
FIG. 14A is a diagram showing a job order before a sort in a fifth preferable embodiment of the image-forming apparatus.

The following will describe a fifth preferable embodiment of the image-forming apparatus. In this fifth preferable embodiment, plural jobs for forming plural images are performed. FIGS. 14A and 14B show a job order in the fifth preferable embodiment of the image-forming apparatus.

A job (JOB1) for printing the image, according to the image data, a length of which along the width direction thereof is long and jobs (JOB2 and JOB3) each for printing the image, according to the image data, a length of which along the width direction thereof is short are mixed in FIG. 14A.

For example, this is a case in which the JOB 1 and the JOB2 and JOB3 are mixed is preset in the image-forming apparatus 40. Specifically, the plural jobs are input to the control portion 70 from outside and they are classified into a job for printing the image, according to the image data, a length of which along the width direction thereof is longer than a predetermined threshold value and a job for printing the image, according to the image data, a length of which along the width direction thereof is shorter than the predetermined threshold value, based on image data of each job. Their job orders are then sorted.

According to the fifth preferable embodiment of the invention, when plural jobs are preset, their job orders are sorted. In this embodiment, JOB2 and JOB3 are printed prior to JOB1. For example, by sorting the job orders, JOB2 and JOB3 are printed prior to the first JOB1, as shown in FIG. 14B.

Thus, by performing the sort processing of the preset job order based on the size of image data of the jobs, it is possible to form the images starting from the image which receives any less influence of the wobbling of the roll sheet 18. This allows starting forming the images soon, thereby enabling an amount of waste sheet to be reduced.

The following will describe a sixth preferable embodiment of the image-forming apparatus. In this sixth preferable embodiment, the damping profile (see FIG. 6) that is similar to that of the second embodiment of the invention is used.

Figure 15:
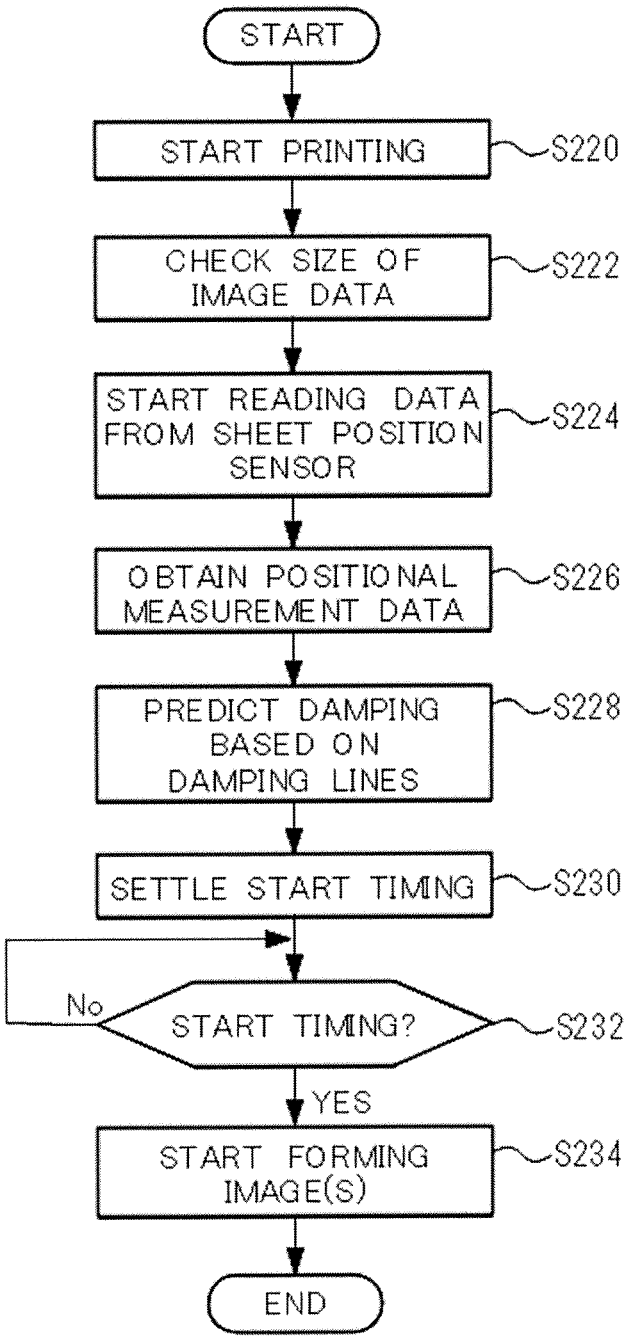
FIG. 15 is a flowchart showing a control of starting forming the image in the image-forming apparatus according to a sixth preferable embodiment of the invention.

FIG. 15 shows a control of starting forming the image in the image-forming apparatus according to a sixth preferable embodiment of the invention.

When a user turns on a power switch of the image-forming apparatus 40, the control portion 70 starts operation of the image-forming apparatus 40.

At a step, S220 of FIG. 15, when the user pushes a print start button in the manipulation and representation portion 76, the control portion 70 controls the printer 42 to start printing the image and controls the feeder 14 to start feeding the roll sheet 18.

At a step, S222, the control portion 70 checks a size of image data. The control portion 70 obtains the size of image data along a width direction of the image which is perpendicular to the conveying direction of the roll sheet 18 based on the image data received from outside.

At a step, S224, the control portion 70 starts reading the positional measurement data from the sheet position sensor 60. Specifically, the sheet position sensor 60 successively measures a position of the roll sheet 18 along the width direction thereof and successively sends the positional measurement data to the control portion 70.

At a step, S226, the control portion 70 obtains the positional measurement data. Specifically, the control portion 70 obtains the positional measurement data from the sheet position sensor 60.

At a step, S228, the control portion 70 predicts the damping based on the straight lines L1 and L2 shown in FIG. 6. As described above, the control portion 70 calculates the damping wave based on the damping profile.

At a step, S230, the control portion 70 settles start timing. The start timing is settled on the basis of the image data. The wobbling width can be predicted on the basis of the calculated damping wave. When a length which subtracts the wobbling width from the length of the roll sheet 18 along the width direction thereof is set as the allowable range and the length of the image according to the image data along the width direction thereof becomes within the allowable range, this timing is settled as the start timing.

At a step, S232, the control portion 70 determines whether or not it reaches the starting timing based on the calculated damping wave.

If it is determined that it reaches the starting timing, namely, in a YES case of the step, S232, the control portion 70 goes to the step, S234 where the control portion 70 starts forming the image. Thus, the control portion 70 completes the processing.

If it is determined that it does not reach the start timing, namely, in a NO case of the step, S232, the control portion 70 repeats the step, S232.

The above-mentioned wobbling width is sinusoidally damped, so that the allowable range is enlarged. Therefore, it is determined that the image can be soon formed if the length of the image 80 according to the image data along the width direction thereof is shorter than that of the image 80 according to the image data along the length direction thereof. The start timing is settled on the basis of this. On the other hand, it is determined that the image can be formed when the wobbling width becomes small if the length of the image 80 according to the image data along the width direction thereof is longer than that of the image 80 according to the image data along the length direction thereof. If so, the start timing is settled on the basis of this.

In the image-forming apparatus according this embodiment, the damping wave is calculated on the basis of the positional measurement data, which is measured by the sheet position sensor 60, and the image data and the wobbling width is predicted. The start time is controlled on the basis of the prediction of the wobbling width. Specifically, it is possible to reduce an amount of waste sheet because it is determined that the image can be soon formed from the start of the conveyance of the roll sheet 18 if the length of the image 80 according to the image data along the width direction thereof is shorter than that of the image 80 according to the image data along the length direction thereof. On the other hand, it is determined that the image can be formed when the wobbling width becomes small if the length of the image 80 according to the image data along the width direction thereof is longer than that of the image 80 according to the image data along the length direction thereof so that it is possible to maintain an image quality without any protrusion of the image from the roll sheet 18.

Although a case where the control portion 70 controls the image-forming portion 78 to start forming the image when it is determined that the image can be stably formed has been described, the control portion 70 can control the image-forming portion 78 to previously start an image-forming preparation operation before the damping vibration of the roll sheet 18 along the width direction thereof converges. Namely, the exposing portion exposes a surface of each of the photosensitive drums 46 to form an electrostatic latent image thereon. The toner images corresponding to the electrostatic latent images are transferred to the intermediate transfer belt 47. These operations are performed before the damping vibration of the roll sheet 18 along the width direction thereof actually converges. When reaching the stable time when the damping vibration of the roll sheet 18 along the width direction thereof converges, the toner images transferred to the intermediate transfer belt 47 are directly transferred to the roll sheet 18 to form the image. Thus, the control portion 70 finishes forming the image on the roll sheet 18. According to this embodiment of the invention, it is possible to substantially reduce an amount of waste sheet.

Although the preferable embodiments of this invention have been described with reference to the drawings, various kinds of variations and/or modifications may be applied thereto without deviating from the gist of this invention. For example, the printer may be, in addition to the electrophotographic printer, an ink jet printer, a dot impact printer and the like, as far as they use a sheet of continuous paper.

Although the cases where the roll sheet 18 is used as the sheet of continuous paper have been described in the preferable embodiments, the invention can be applied to other sheet of continuous paper such as a performed form sheet. This invention can be applied to not only paper but also printable (continuous) recording medium such as filmed recording medium.

According to this invention, it is possible to provide the image-forming apparatus with an application which can be implemented by a computer as the programs for the preferable embodiments. These programs for the preferable embodiments may be installed as a function of a part of various kinds of applications implemented on a personal computer.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

What is claimed is:

1. An image-forming apparatus that forms an image on a sheet of continuous recording medium, the apparatus comprising:

an image-forming portion that receives the sheet of continuous recording medium and forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls at least one of start time of image-forming operation in the image-forming portion and an image-writing position of the image-forming portion by fixing at least one of the start time of the image-forming operation in the image-forming portion and the image-writing position of the image-forming portion, based on positional measurement data about the position of the sheet of continuous recording medium along the width direction thereof, the positional measurement data being measured by the sheet position sensor, wherein the control portion controls the image-forming portion to start forming the image on the sheet of continuous recording medium when determining that a vibration of the sheet of continuous recording medium along the width direction thereof becomes stable based on the positional measurement data from the sheet position sensor.

2. An image-forming apparatus that forms an image on a sheet of continuous recording medium, the apparatus comprising:

an image-forming portion that receives the sheet of continuous recording medium and forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls at least one of start time of image-forming operation in the image-forming portion and an image-writing position of the image-forming portion by fixing at least one of the start time of the image-forming operation in the image-forming portion and the image-writing position of the image-forming portion, based on positional measurement data about the position of the sheet of continuous recording medium along the width direction thereof, the positional measurement data being measured by the sheet position sensor, wherein the control portion calculates stable time when the vibration of the sheet of continuous recording medium along the width direction thereof becomes stable based on the positional measurement data from the sheet position sensor and controls the image-forming portion to previously start an image-forming preparation operation before the calculated stable time and to start forming the image on the sheet of continuous recording medium from the calculated stable time.

3. An image-forming apparatus that forms an image on a sheet of continuous recording medium, the apparatus comprising:

an image-forming portion that receives the sheet of continuous recording medium and forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls at least one of start time of image-forming operation in the image-forming portion and an image-writing position of the image-forming portion by fixing at least one of the start time of the image-forming operation in the image-forming portion and the image-writing position of the image-forming portion, based on positional measurement data about the position of the sheet of continuous recording medium along the width direction thereof, the positional measurement data being measured by the sheet position sensor, wherein the control portion calculates stable time when the vibration of the sheet of continuous recording medium along the width direction thereof becomes stable and a stable position where the vibration of the sheet of continuous recording medium along the width direction thereof becomes stable, based on the positional measurement data from the sheet position sensor and controls the image-forming portion to previously start an image-forming preparation operation before the calculated stable time and to start forming the image on the sheet of continuous recording medium from the calculated stable time.

4. The image-forming apparatus according to claim 3 wherein the control portion reads the positional measurement data from the sheet position sensor for every sheet of continuous recording medium and calculates at least one of the stable time and the stable position.

5. The image-forming apparatus according to claim 3 wherein a damping profile relating to damping of the vibration of the sheet of continuous recording medium along the width direction thereof is provided for every species of the sheet of continuous recording medium and for every range of paper weight of the sheet of continuous recording medium, and the control portion calculates at least one of the stable time and the stable position, with referring to the damping profile when conveying the sheet of continuous recording medium.

6. The image-forming apparatus according to claim 5 wherein the control portion reads the positional measurement data from the sheet position sensor when exchanging parts of the image-forming apparatus relating to the vibration of the sheet of continuous recording medium along the width direction thereof; and the control portion newly sets at least one of the stable time and the stable position.

7. The image-forming apparatus according to claim 5 wherein the control portion calculates at least one of the stable time and the stable position, with referring to setting according to the damping profile, when a fixing portion separates and compresses the sheet of continuous recording medium but parts of the image-forming apparatus relating to the vibration of the sheet of continuous recording medium along the width direction thereof are not exchanged.

8. The image-forming apparatus according to claim 5 wherein the control portion controls the image-forming portion to form the image on the sheet of continuous recording medium based on at least one of the stable time and the stable position of an immediately preceding image-forming operation, when a fixing portion does not separate nor compress the sheet of continuous recording medium and parts of the image-forming apparatus relating to the vibration of the sheet of continuous recording medium along the width direction thereof are not exchanged.

9. An image-forming apparatus that forms an image on a sheet of continuous recording medium, the apparatus comprising:

an image-forming portion that forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls start time of image-forming operation of the image-forming portion based on positional measurement data about the position of the sheet of continuous recording medium along the width direction thereof, the positional measurement data being measured by the sheet position sensor, and image data to form the image on the sheet of continuous recording medium by the image-forming portion, wherein the control portion controls the image-forming portion to start forming the image on the sheet of continuous recording medium when determining that vibration of the sheet of continuous recording medium along the width direction thereof becomes stable based on the positional measurement data and the image data.

10. The image-forming apparatus according to claim 9 wherein the control portion controls the image-forming portion to start forming the image when the control portion determines that an amount of vibration of the sheet of continuous recording medium along the width direction thereof is a first mount of vibration or less based on the positional measurement data in a case where the length of the image according to the image data along the width direction thereof is shorter than that of the image according to the image data along a direction that is perpendicular to the width direction thereof; and the control portion controls the image-forming portion to start forming the image when the control portion determines that the amount of vibration of the sheet of continuous recording medium along the width direction thereof is a second mount of vibration or less based on the positional measurement data in a case where the length of the image according to the image data along the width direction thereof is longer than that of the image according to the image data along the direction that is perpendicular to the width direction thereof, the second mount of vibration being less than the first mount of vibration.

11. An image-forming apparatus that forms an image on a sheet of continuous recording medium, the apparatus comprising:

an image-forming portion that forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls start time of image-forming operation of the image-forming portion based on positional measurement data about the position of the sheet of continuous recording medium along the width direction thereof, the positional measurement data being measured by the sheet position sensor, and image data to form the image on the sheet of continuous recording medium by the image-forming portion, wherein when it is determined on the basis of the positional measurement data the length of the image according to the image data along the width direction thereof is longer than that of the image according to the image data along a direction that is perpendicular to the width direction thereof, the control portion controls the image-forming portion to make start time of image-forming operation later than the start time of image-forming operation when the length of the image according to the image data along the width direction thereof is shorter than that of the image according to the image data along a direction that is perpendicular to the width direction thereof.

12. An image-forming apparatus that forms an image on a sheet of continuous recording medium, the apparatus comprising:

an image-forming portion that forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls start time of image-forming operation of the image-forming portion based on positional measurement data about the position of the sheet of continuous recording medium along the width direction thereof, the positional measurement data being measured by the sheet position sensor, and image data to form the image on the sheet of continuous recording medium by the image-forming portion, wherein the control portion calculates an amount of vibration of the sheet of continuous recording medium along the width direction thereof and a vibration cycle based on the positional measurement data and controls the start time of the image-forming operation of the image-forming portion based on a size of the image data.

13. An image-forming apparatus that forms an image on a sheet of continuous recording medium, the apparatus comprising:

an image-forming portion that forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls start time of image-forming operation of the image-forming portion based on positional measurement data about the position of the sheet of continuous recording medium along the width direction thereof, the positional measurement data being measured by the sheet position sensor, and image data to form the image on the sheet of continuous recording medium by the image-forming portion, wherein the control portion controls the start time of the image-forming operation of the image-forming portion for plural items of the image data based on each of the plural items of the image data, the plural items of the image data being different from each other in a length of the image according to the image data along the width direction thereof, and wherein the control portion controls the start time of the image-forming operation of the image-forming portion to start forming the image with the shorter length along the width direction thereof according to the image data prior to formation of the image with the longer length along the width direction thereof according to the image data.

14. An image-forming apparatus that forms an image on a sheet of continuous recording medium, the apparatus comprising:

an image-forming portion that forms the image on the sheet of continuous recording medium;

a sheet position sensor that measures a position of the sheet of continuous recording medium along a width direction thereof, the width direction being perpendicular to a conveying direction of the sheet of continuous recording medium conveyed to the image-forming portion; and a control portion that controls start time of image-forming operation of the image-forming portion based on positional measurement data about the position of the sheet of continuous recording medium along the width direction thereof, the positional measurement data being measured by the sheet position sensor, and image data to form the image on the sheet of continuous recording medium by the image-forming portion, wherein the control portion predicts time when the vibration of the sheet of continuous recording medium along the width direction becomes stable based on the positional measurement data and the image data and controls the image-forming portion to start forming the image based on a result of the prediction.

* * * * *